US007251854B2

(12) United States Patent
Gerth et al.

(10) Patent No.: US 7,251,854 B2
(45) Date of Patent: Aug. 7, 2007

(54) VACUUM CLEANER WITH A DUST COLLECTION CHAMBER CLOSEABLE BY A LID

(75) Inventors: Volker Gerth, Bielefeld (DE); Udo Mersmann, Guetersloh (DE); Heinz-Guenter Steinkoetter, Bielefeld (DE)

(73) Assignee: Miele & Cie. KG., Guetersloh (DE)

( * ) Notice: Subject to any disclaimer, the term of this patent is extended or adjusted under 35 U.S.C. 154(b) by 551 days.

(21) Appl. No.: 10/901,572

(22) Filed: Jul. 29, 2004

(65) Prior Publication Data

US 2005/0022335 A1 Feb. 3, 2005

(30) Foreign Application Priority Data

Jul. 29, 2003 (DE) ..... 103 34 894

(51) Int. Cl.
*A47L 9/14* (2006.01)

(52) U.S. Cl. ..... 15/352; 15/327.7; 55/374

(58) Field of Classification Search ..... 15/347, 15/327.7, 352, DIG. 2; 55/374, 376, DIG. 2; *A47L 9/14*
See application file for complete search history.

(56) References Cited

U.S. PATENT DOCUMENTS 4,591,369 A * 5/1986 Stewart, Sr. et al. ..... 55/374
4,738,697 A * 4/1988 Westergren ..... 55/376
5,699,585 A * 12/1997 Tomooka et al. ..... 15/327.7
7,076,832 B2 * 7/2006 Albert et al. ..... 15/352

FOREIGN PATENT DOCUMENTS

| | | | |
|---|---|---|---|
| DE | 196 51 027 A1 | | 5/1998 |
| EP | 0044501 | * | 7/1981 |
| JP | 08-173360 | * | 7/1996 |
| JP | 2000-126100 | * | 5/2000 |

* cited by examiner

*Primary Examiner*—Theresa T. Snider
(74) *Attorney, Agent, or Firm*—Darby & Darby

(57) ABSTRACT

A vacuum cleaner for use with a dust bag provided with a flange adapted to be slidably received in a bracket pivotally mounted in a dust collection chamber between a first position in engagement with a suction opening of the dust collection chamber and a second position removed from the first position. The dust collection chamber is provided with a lid selectively pivotable between open and closed positions. Movement of the lid to its closed position is contingent upon the flange of a dust bag having been inserted into the bracket to release the bracket from a blocking mechanism effective in the second position of the bracket and constituted by an upper edge of the bracket and a groove in the lid.

5 Claims, 2 Drawing Sheets

VACUUM CLEANER WITH A DUST COLLECTION CHAMBER CLOSEABLE BY A LID

BACKGROUND OF THE INVENTION

1. Field of the Invention

The invention, in general, relates to a vacuum cleaner provided with a dust collection chamber which may be closed by a lid and, more particularly, to a vacuum cleaner of the type provided with a spring-biased bracket for receiving a flange attached to a dust bag in alignment with a suction connector, whereby the bracket with the inserted flange of a dust collection allows free movement of the lid along its path toward a closing position and blocks such movement by the lid engaging a blocking cam mounted on the bracket.

In a vacuum cleaner known from German patent specification DE 19651 027 A1 the upper side of the dust collection chamber of which may be closed by a lid provided with a suction connector, the bracket for receiving a flange affixed to the dust bag is mounted in the dust collection chamber for pivoting movement against the bias of a spring about an axis of rotation extending substantially parallel to the axis of the lid. The bracket may be pivoted substantially in the plane of the lid. In the absence of a dust bag, the suction connector can, however, unimpededly penetrate through the bracket. A rib provided on the interior surface of the lid then engages a blocking cam provided on the bracket which prevents further closing movement of the dust collection chamber lid. If, on the other hand, a dust bag has been attached, the suction connector, during closing movement of the lid will engage the gasket or the flange affixed to the dust bag disposed therein. During further closing movement the bracket is pivoted downwardly against the bias of a spring by the force exerted on the bracket by the suction connector. The closure path of the rib on the lid is freed by the simultaneous pivoting of the blocking cam of the bracket so that the dust chamber lid may be moved into its full closure position.

The known arrangement can only be realized, however, in a vacuum cleaner in which, on the one hand, the suction connector is disposed directly on the dust chamber lid and in which, on the other hand, the pivot axis of the dust bag mounting bracket extends substantially parallel to the axis of the lid in the upper region of the dust collection chamber. The teaching of the prior art cannot be applied, however, to a vacuum cleaner provided with a suction collector rigidly mounted on the housing of the vacuum cleaner and extending into the dust collection chamber thereof, in which the dust bag is inserted, after removing the lid, from above, and which the pivot axis of the lid may extend transversely of the axis of the bracket. More particularly, the known arrangement suffers from the disadvantage that the lid may be unimpededly closed even if the dust bag has not been properly attached to its bracket since the suction connector moves into engagement with the flange of the dust bag even if the opening of the bag is not properly or coaxially aligned with the suction connector.

2. Objects of the Invention

It is a general object of the invention to provide a vacuum cleaner which cannot be operated unless a dust bag has been properly mounted in its dust collection chamber.

A more general objects resides in the provision of a vacuum cleaner provided with a dust collection chamber with a lid which cannot be moved to its full closure position unless a dust bag has been properly installed in the dust collection chamber.

Another object of the invention is to provide a vacuum cleaner which cannot be operated unless a dust bag has been installed in it in proper alignment with a suction opening.

Other objects will in part be obvious and will in part appear hereinafter.

SUMMARY OF THE INVENTION

In the accomplishment of these and other objects, the invention provides, in a preferred embodiment thereof, a vacuum cleaner provided with a dust collection chamber for receiving a dust bag and provided with a lid pivotable between open and closed positions, and with a bracket pivotable between first and second positions about an axis substantially parallel to the axis of the lid for mounting the dust bag, the lid and the bracket being provided with structurally simple means which prevent movement of the lid into its closure position if no dust bag is properly mounted on the bracket and which allow movement of the lid to its closing position with a dust bag mounted on the bracket.

The invention without utilizing complex and complicated lever mechanisms provides an advantageous and simple way of preventing closure of the lid of the dust collection chamber of a vacuum cleaner if inadvertently no dust bag has been mounted in its dust collection chamber or if the bag has been mounted improperly. The bracket is arranged in the dust collection chamber such that the flange on a dust bag may be inserted into it from above after the lid has been moved to its open position. Replacement of dust bags is thus facilitated. It is immaterial whether the pivot axis of the lid extends transversely of the axis of the bracket or whether it is aligned parallel therewith, i.e. whether lid is pivoted in the transverse or longitudinal plane of the vacuum cleaner.

DESCRIPTION OF THE SEVERAL DRAWINGS

The novel features which are considered to be characteristic of the invention are set forth with particularity in the appended claims. The invention itself, however, in respect of its structure, construction and lay-out as well as manufacturing techniques, together with other objects and advantages thereof, will be best understood from the following description of preferred embodiments when read in connection with the appended drawings, in which:

DETAILED DESCRIPTION OF THE PREFERRED EMBODIMENT.

Figure 1:
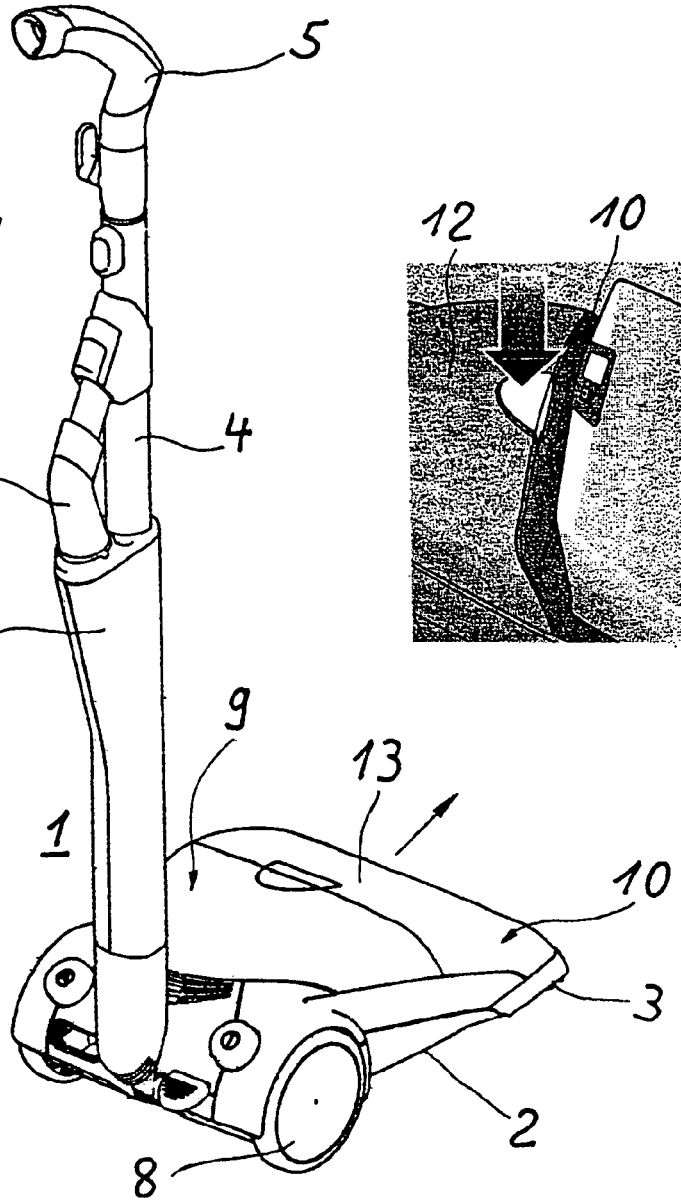
FIG. 1 is a perspective view of an upright vacuum cleaner with its carriage component provided with a dust collection chamber accessible by a lid.
Figure 2:
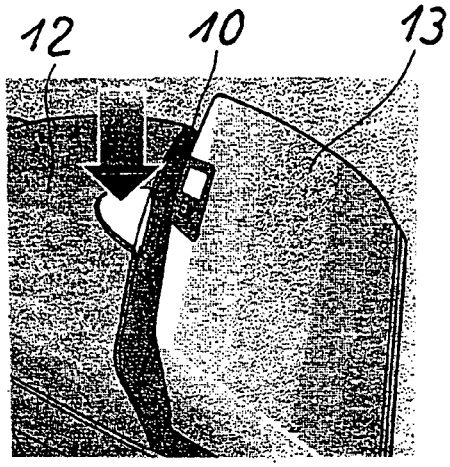
FIG. 2 is a partial perspective view of the carriage component in the area of the dust collection chamber with a lid partially opened.

FIG. 1 depicts a vacuum cleaner 1, more particularly an upright vacuum cleaner provided with a movable carriage component 2, a downwardly directed suction nozzle 3, and a shaft 4 hinged to the carriage portion 2 and provided with a handle 5 and a quiver 6 for receiving a separate vacuum hose 7.

Figure 3:
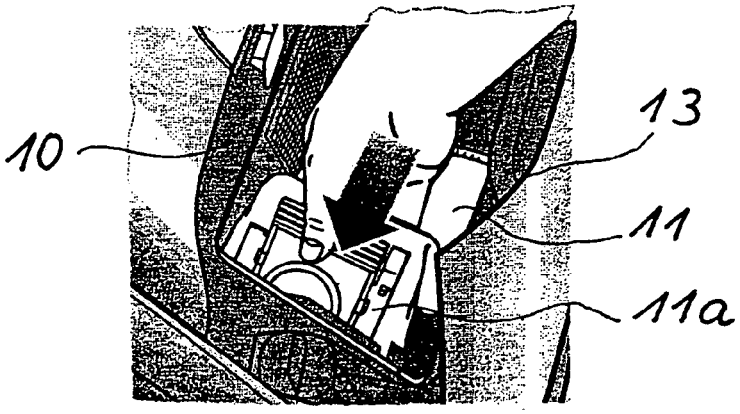
FIG. 3 is a perspective view of the carriage component in the area of the dust collection chamber with the lid opened.

The carriage portion 2 which is provided with wheels or castors 8 consisting of a lower bowl-shaped housing portion and a complementary upper bowl-shaped housing portion to form a vacuum cleaner housing divided into a chamber 9 for a motorized blower for receiving a vacuum blower (not shown) and a dust collection chamber 10 for receiving a replaceable dust bag 11 (FIG. 3). The two chambers are each accessible by pivotable lids 12, 13, the pivot axes of which are preferably aligned parallel to each other in the longitudinal or suction direction (see arrow in FIG. 1) of the vacuum cleaner housing or carriage component 2. The lid 13 associated with the dust collection chamber 10 opens in the forward direction and the lid 12 associated with the motor chamber opens towards the rear (not shown). However, the lids 12, 13 may also be mounted on the housing such that either or both of them may be pivoted transversely of the direction of suction. The pivot axis 14 of the lid 13 relating to the dust collection chamber 10 is indicated in FIGS. 4 to 6.

As is well known, in the flow direction the suction blower (not shown) in the blower housing 9 is positioned behind the dust collection chamber 10 or the dust bag 11 disposed therein. The dust picked up by the suction nozzle 3 during operation of the vacuum cleaner is fed by way of a suction connector 15 of the carriage portion 2 entering into the dust collection chamber 10 into a dust bag 11 connected to the connector. For aligning the replaceable dust bag 11 relative to the suction connector 15, the dust collection chamber 10 is provided with a spring biased bracket 16 positioned in front of the suction connector 15. When the lid is in its open position, a flange 11*a* affixed to the dust bag 11 may be slid into the bracket 16 from above. During this instant the bracket 16 is pivoted away from the suction connector 15 (see FIGS. 3 and 4). The bracket 16 is mounted for pivotal movement about a horizontal axis 19 near the interior bottom wall of the dust collection chamber 10 and is provided with a substantially U-shaped frame member 17 for receiving the flange 11*a* of the dust bag 11.

Figure 4:
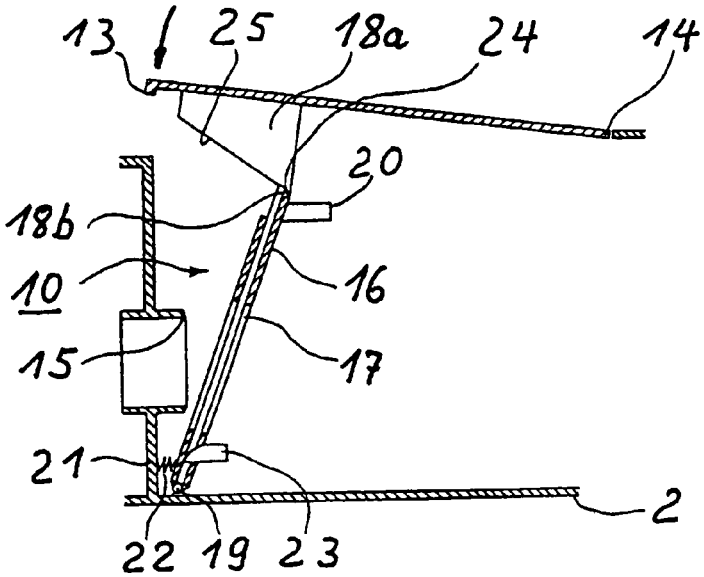
FIG. 4 is a simplified sectional view of the dust collection chamber with a lid blocking feature in accordance with the invention, without installed dust bag.
Figure 5:
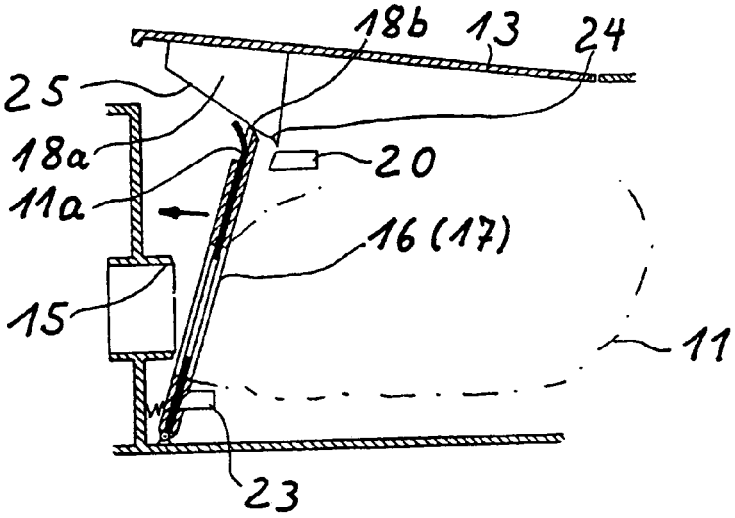
FIG. 5 depicts the dust collection chamber of FIG. 4 with the lid opened and a dust bag installed.
Figure 6:
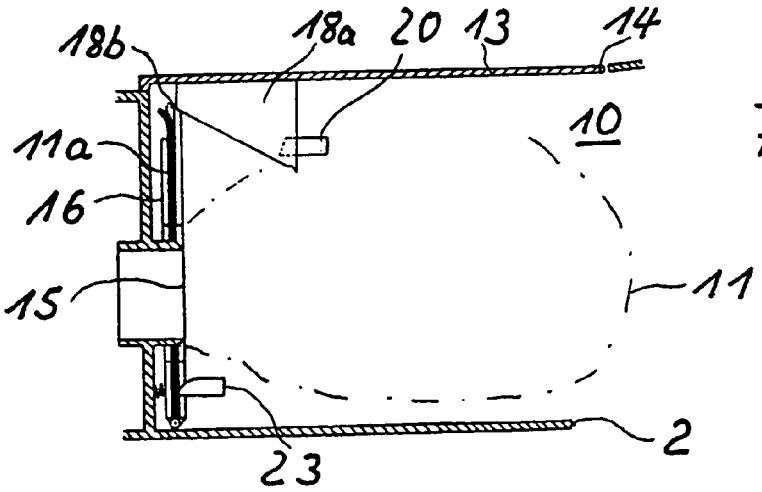
FIG. 6 shows the dust collection chamber of FIG. 5 with an installed dust bag and the lid closed.

For preventing closure of the lid 13 of the dust collection chamber 10 while no dust bag 11 has been inserted and inadvertent operation of the vacuum cleaner 1 with a dust bag 11 which would result in dust-laden air entering the blower 1 and interfere with its proper functioning, there is provided, in accordance with the invention, a blocking feature 18 (see FIGS. 4 to 6). The blocking feature 18 consists of a rib 18*a* affixed to the lid 13 and a blocking cam 18*b* mounted on the bracket 16 and is activated if no dust bag 11 has been properly inserted into the dust collection chamber 10, i.e. if the flange 11*a* of the dust bag 11 has not been properly slid into the frame member 17 of the bracket 16.

The safety device or blocking feature operates such that the bracket 16 for the flange 11*a* moves into a position in which, on the one hand, it prevents closing movement of the lid 13 if no dust bag 11 has been inserted (see FIG. 4) and, on the other hand, permits closing movement of the lid 13 if a dust bag has been installed into the bracket 16 (see FIG. 5). In the blocking position the rib 18*a* of the lid 13 moves against the blocking cam 18*b* of the dust bag receiving bracket 16.

The bracket 16 for receiving the flange 11*a* of the dust bag 11 is pivotally movable about the horizontal axis 19 at the bottom of the dust collection chamber 10 between a position in which it engages the suction connector 15 rigidly mounted on the housing and an abutment 20 also rigidly mounted on the housing. If no dust bag 11 has been inserted, the bracket 16 will be spring biased against the abutment 20. The bias may be generated by a compression spring 22 seated between a housing wall 21 of the dust collection chamber 10 and the bracket 16 or by a torsion spring (not shown) in the pivot bearing of the bracket 16.

Near the bottom of the dust collection chamber 10 and associated with the bracket 16 and U-shaped frame member 17 there is provided a sliding abutment 23 for the flange 11*a* of the dust bag 11 to be inserted from above. If no dust bag 11 is present, the sliding abutment 23 unimpededly protrudes into the pivot plane of the bracket 16 (see FIG. 4) with the latter unimpededly moving into engagement with the abutment 20. In this position of the bracket 16, the blocking cam 18*b* disposed at the upper portion of the bracket 16 would engage a notch 24 in the rib 18*a* at the lower surface of the lid 13 if an attempt were made to close the lid 13. This results in the desired blocking action. Further ribs with or without notches could be provided on the lid 13 which would result in added safety in case the lid 13 becomes deformed during its closing movement. The ribs 18*a* are provided with wedge-shaped inclinations 25 for pivoting the bracket 16 towards and against the suction connector 15 provided a dust bag 11 has been installed (see arrow, FIGS. 5 and 6). The sliding abutment 23 in the dust collection chamber 10 may also be affixed to the abutment 20.

If a dust bag 11 is inserted while the lid 13 is open, the lower edge of its flange 11*a* will move into engagement with an inclined upper surface of the sliding abutment 23. Further downward movement of the flange 11*a* causes the bracket 16 to move along the length of the abutment 23 in the direction of the suction connector 15 and pivot about a corresponding angle. The abutment 23 will then engage the surface of the flange 11*a* centered in the bracket 16. Pivoting of the bracket 16 causes the blocking cam 18*b* above the flange 11*a* to escape the effective range of the notch 24 of the rib 18*a*, so that the lid 13 may be moved to its closing position. During closing movement of the lid 13, the inclination 25 of the rib 18*a* now pushes laterally against to upper margin of the bracket 16 or against the blocking cam 18*a* and causes the bracket 16 to pivot into a vertical disposition which leads to a seal between the suction opening of the flange 11*a* or dust bag 11 and the suction connector inserted into the opening in the bracket 16. The dust collection chamber is thus closed for effective vacuuming. If the dust bag 11 is to be replaced, the bracket 16 is first pivoted off the suction connector, and the dust bag 11 is pulled out of the bracket 16. If thereafter no new dust bag is inserted, the blocking feature in accordance with the invention will effective prevent closure of the dust collection chamber and operation of the vacuum cleaner.

What is claimed is:

1. A vacuum cleaner for use with a dust bag of the kind provided with a flange surrounding a dust input opening, comprising:

a housing forming a dust collection chamber therein;

a lid provided with an abutment and mounted on the housing for pivotal movement between open and closed positions;

a suction connector forming an opening in a wall of the housing;

an bracket forming an aperture and provided with an upper edge and mounted in the dust collection chamber for pivotal movement between a first position in which the bracket engages the wall and the aperture is substantially concentrically aligned with the opening and a second position in which the upper edge engages the abutment;

a frame member mounted on the bracket for slidably inserting the flange when the bracket is in its second position;

a protrusion mounted in the dust collection chamber and responsive to insertion of the flange for initiating movement of the bracket toward its first position and the upper edge thereof away from the abutment.

2. The vacuum cleaner of claim 1, wherein the abutment is provided with a notch for releasably receiving the upper edge and with an inclined surface for moving the bracket towards its first position during closing movement of the lid.

3. The vacuum cleaner of claim 2, wherein the bracket is provided with a spring for biasing the bracket towards its second position.

4. The vacuum cleaner of claim 3, wherein the spring is a compression spring provided between the bracket and the wall.

5. The vacuum cleaner of claim 1, wherein the lid is pivotable about an axis parallel to the wall.

* * * * *